United States Patent [19]

Sanchez

[11] Patent Number: 4,710,981

[45] Date of Patent: Dec. 8, 1987

[54] INTERACTIVE MESSAGE GARMENT

[76] Inventor: David J. Sanchez, 3430 Arbor Dr., Pleasanton, Calif. 94566

[21] Appl. No.: 934,431

[22] Filed: Nov. 24, 1986

[51] Int. Cl.[4] ..... A41B 1/00

[52] U.S. Cl. ..... 2/115; 2/246; 40/586

[58] Field of Search ..... 2/115, 159; 40/586; 2/246

[56] References Cited

U.S. PATENT DOCUMENTS

| | | | |
|---|---|---|---|
| 1,624,429 | 4/1927 | Palmer | 2/159 |
| 2,647,261 | 8/1953 | Rassner | 2/246 X |
| 2,871,485 | 2/1959 | Greco | 2/246 X |
| 3,484,974 | 12/1969 | Culmone | 2/115 |
| 3,999,521 | 12/1976 | Puiello | 40/586 X |
| 4,277,848 | 7/1981 | Boehland | 2/115 |
| 4,296,498 | 10/1981 | Vinson | 2/115 |
| 4,441,271 | 4/1984 | Hutchinson | 40/586 X |

*Primary Examiner*—Peter Nerbun

*Attorney, Agent, or Firm*—Joseph L. Strabala

[57] ABSTRACT

Wearing apparel consisting of a garment which includes a flap with a releasable gripping surface hinged on one of the garment's exposed surface panels and constructed so that the end of the flap which is not hingedly connected can be swung away from the garment's panel to flash or expose a written indicia on the underside of the flap and against the panel so the gripping surface will hold the flap in place on the panel when so positioned.

5 Claims, 3 Drawing Figures

INTERACTIVE MESSAGE GARMENT

BACKGROUND OF THE INVENTION

Today many members of our society wear articles of clothing which have imprinted thereon various logos and/or statements. Such logos and/or statements run the gambit from personal statements to advertising displays and then to the less ostentatious trademarks, e.g., Jordache, Lees and Levis on jeans pockets.

One difficulty with these popular items of clothing is the wearer cannot interact with the statement beyond merely wearing the garment.

The current invention enables the person wearing the instant invention to make a personal statement through interaction his or her apparel by opening or closing a panel thereon to reveal or flash a written "Message" to his contemporaries. Sports fans in particular, given to fits of disdain when referee calls are made against the home team. At times expletives are not sufficient for sports fans and they are given to more cogent means of communicating their ire which is sometimes vented by showering their favorite referee with conveniently available missiles, such as beer cans or the like.

Thus, the instant invention provides a means for less offensive but an equally expressive means of displaying of the frustrations of sports fans without risking bodily harm. However, by no mean is the instant invention limited in its use to sports fans, as there are many other situation where "Messages" can be communicated to others by manipulation of the novel garment provided by the instant invention.

SUMMARY OF THE INVENTION

The current invention provides an article of wearing apparel which gives the wearer that extra measure of interactive expression by providing a garment constructed of panels with a gripping surface on one of its outer panels, a flap hingedly connected along one edge of the flap to the panel of the garment adjacent to the gripping surface and operable to allow the flap to be opened or closed against the gripping surface, whereby certain written indicia under the flap can be displayed at the wearer's option.

DESCRIPTION OF THE DRAWINGS

The invention will be better understood by reference to the accompanying drawings illustrating the invention wherein.

DESCRIPTION OF THE PREFERRED EMBODIMENT

Figure 2:
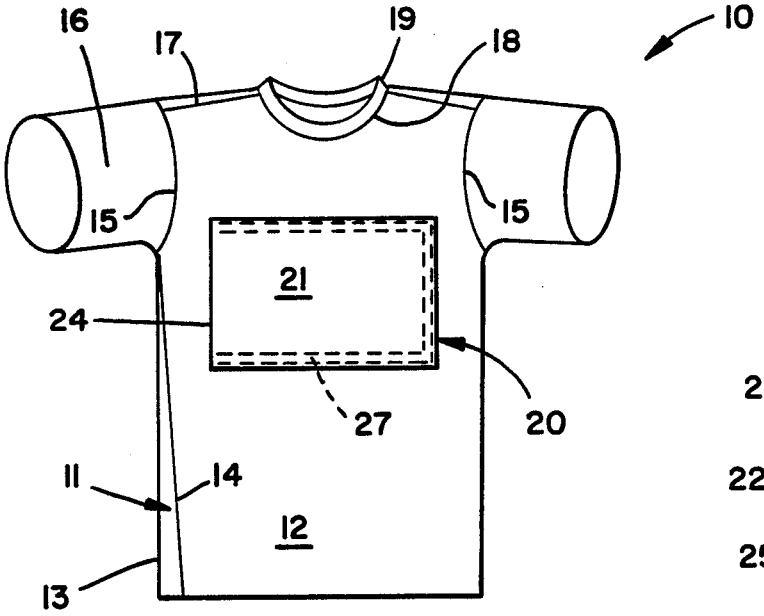
FIG. 2 is an perspective of the garment shown in FIG. 1 illustrating it embodied in a shirt configuration with the flap closed.

Generally the instant invention can employ as its basic component a garment 10, such as a sweatshirt 11, which has at least a front panel 12 and a rear panel 14. A side seam 14 along each of the opposite edges of the front and rear panels join them in a sack-like configuration with arm openings 15 on each side near the top for attachment of the sleeves 16, if desired, which construction can be seen in FIGS. 1 and 2. Between seams 14, and across the top end of the joined panels, the two panels are connected with a top seam 17 which closes the top of the garment with the exception of a neck or collar opening 18. A bias or welt 19 can be employed to encircle the neck opening to cover the salvage edges of the material from which the shirt has been constructed.

Generally the shirt described above is generic to the the type of garments forming the basic component of the invention. Any any garment having a similar front panel 12 can be employed for this purpose from sweatshirts to bib overalls.

Figure 3:
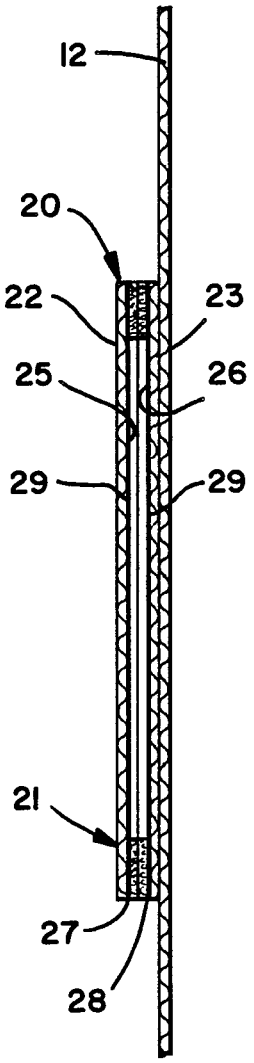
FIG. 3 is a broken away, cross-section of the flap pocket of the garment shown in FIGS. 1 and 2.
Figure 1:
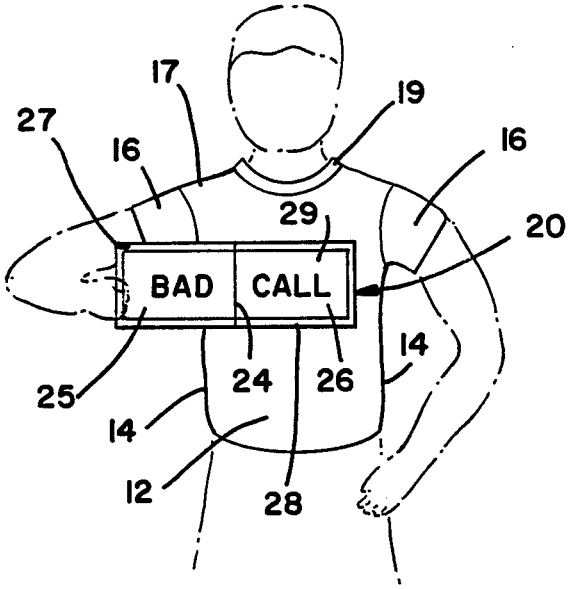
FIG. 1 is an elevation of the novel flap garment with a model indicated in phantom showing how the invention is operated.

In the embodiment of the invention illustrated in the drawings a flap pocket 20, which construction is best illustrated in FIG. 3, is attached to the garment shown in FIGS. 1 and 2 to fabricate the invention. This construction typically involves an elongated rectangular strip 21 formed of a suitable material, which most often is the same material from which the sweatshirt 11 is made. The strip is folded in half so it has a front pocket panel 22 connected to a rear pocket panel 23 through their fold line which forms a hinge 24.

As a result the rectangular flap pocket 20 is formed which must have the remaining edges releasably connected to complete it. In this respect the edges of the continuous, overlapped faces 25 and 26 of the front and rear panels are lined with a gripping surface, such as VELCRO(TM) material. Typically these materials have a A part and a B part. The A part has has spines with hooks and the B part has upstanding loops. When the spines are pushed into the loops the hooks engage the loops releasably joining the A and B parts until sufficient force is applied to pull the hooks free from the loops. Thus a gripping strip 27 of A material can be used to line the peripheral edges of face 25 of the front pocket panel 22 and a gripping strip 28 of B material can be employed to line the peripheral edges of face 26 of the rear pocket panel 23, as is best illustrated in FIG. 3.

When the gripping surfaces on the faces 25 and 26 are superimposed on one another, a closed pocket 20 is formed enclosed by the gripping strips 27 and 28 along three edges and a hinge 24 along the forth edge.

The faces 25 and 26 of this pocket can be lined with a variety of fabrics, including prints, strips and plane fabrics. As can be seen in FIG. 1 the lining 29 is a striped fabric which is sewn on to the face 25 and 26. On the exposed surface of this lining a message or logo is imprinted, for example by stenciling. Some thoughtful logos that can be used to grace this surface are "BULLSHIT", "KILL THE BUM", "BAD CALL", "YOU TURKEY" and "I LOVE NEW YORK".

Once the pocket 20 is fabricated it is sewn on to the front panel 12 of the garment 10 in the location illustrated in the drawings where a wearer of the garment can grab the end of the front pocket panel 22 opposite hinge 24 and open the pocket to the view of his contemporaries.

By no means is the instant invention limited to the construction described. For example the pocket 20 can be formed with a front pocket panel 22 and use part of the outer surface of panel 12 as the rear pocket panel 23. In this construction the liner 29 is used. Once the front pocket panel is sewn to the garment with a seam which will form hinge 24 for the flap.

The invention has already found favor with 49ers football fans and proved delightful at parties. As to the logos which may be employed they are limited only be ones imagination. Indeed the garment can have custom ordered logos.

The forgoing description of the invention is merely for purposes of describing the invention. It is not intended to be limiting.

Having described my invention I claim:

1. An interactive message garment comprising:

a garment of wearing apparel having at least a front panel and a rear panel joined in a sack-like configuration with arm openings and a neck opening at its top;

a flap means hingedly connected on said front panel in its central portion with a vertical hinge axis offset to one side of said front panel in a manner operable to allow one end of said flap means to be swung away from and swung against the outer surface of said front panel; and a continuous gripping surface means arranged between said panel and the peripheral unhinged edges of said flap means operable to releasably maintain said flap against said panel whereby said flap means may be manipulated by the wearer of the garment to display written indicia under said flap means.

2. The interactive message garment defined in claim 1 wherein the flap means is generally rectangular and is hingedly connected to the front panel of the garment along one of its edges form the hinge.

3. The interactive message garment defined in claim 1 wherein the continuous gripping surface is formed of narrow strips of VELCRO( TM ) material.

4. The interactive message garment defined in claim 1 wherein the flap means has a fabric on it underside which had written indicia thereon, which indicia is exposed to view when one end of the flap means is swung away from the front panel by the wearer of the garment.

5. The interactive message garment defined in claim 1 wherein the flap means is formed of a elongated rectangular strip of fabric which is folded in half to form a pocket panel and continuous strips of VELCRO( TM ) material are used as a gripping surface between the superimposed pocket panel parts with the resulting pocket sewn on the front panel of the garment.

* * * * *